US006491383B2

(12) United States Patent
Harajiri

(10) Patent No.: US 6,491,383 B2
(45) Date of Patent: Dec. 10, 2002

(54) HEAD CHIP AND HEAD UNIT

(75) Inventor: Toshihiko Harajiri, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/864,939

(22) Filed: May 24, 2001

(65) Prior Publication Data

US 2002/0003558 A1 Jan. 10, 2002

(30) Foreign Application Priority Data

May 25, 2000 (JP) ..... 2000-154236

(51) Int. Cl.[7] ..... B41J 2/14
(52) U.S. Cl. ..... 347/68
(58) Field of Search ..... 347/54, 56, 68, 347/69, 71; 349/107; 359/608

(56) References Cited

U.S. PATENT DOCUMENTS 4,929,060 A * 5/1990 Sugimoto et al. ..... 349/107
5,724,187 A * 3/1998 Varaprasad et al. ..... 359/608
6,095,641 A 8/2000 Kishi ..... 347/71

FOREIGN PATENT DOCUMENTS

EP 1029678 8/2000
JP 5-94639 * 4/1993 ..... 369/283
JP 10146974 6/1998
WO 00029217 5/2000

* cited by examiner

*Primary Examiner*—Anh T. N. Vo
(74) *Attorney, Agent, or Firm*—Adams & Wilks

(57) ABSTRACT

A head chip and a head unit, in which manufacturing cost is reduced and also manufacturing steps are simplified, are provided. In a head chip 10 in which: partition walls 12 made of piezoelectric ceramic are arranged on two upper and lower sheets of a first board 11 and a second board 16 with predetermined intervals; chambers 13 are defined between the respective partition walls 12; a driver voltage is applied to electrodes 14 provided on the side surfaces of the partition walls 12 to change the capacity in ink flow paths; and the ink filled in the ink flow paths is jetted from nozzle openings, the first board 11 and the second board 16 are formed of a dielectric material; wiring lines 15 which are electrically conducted to the electrodes 14 and elongated to the outside of the end portions of the partition walls 12 in the longitudinal direction, are provided on the surface of any one of the first board 11 and the second board 16; and further the wiring lines 15 include an inorganic conductive film 15*a* as the lowermost layer and metal films 15*b* and 15*c* formed thereon.

14 Claims, 14 Drawing Sheets

PRIOR ART

PRIOR ART

HEAD CHIP AND HEAD UNIT

BACKGROUND OF THE INVENTION

1. Field of the Invention

The present invention relates to a method for manufacturing a head chip which is mounted on an ink-jet type recording apparatus applicable to, for example, a printer and a facsimile.

2. Description of the Related Art

Conventionally, an ink-jet type recording apparatus is known in the technical field, in which a recording head for jetting ink droplets from a plurality of nozzles is employed to record characters and/or images on a recording medium. In such an ink-jet type recording apparatus, the recording head positioned opposite to the recording medium is provided on a head holder, and this head holder is mounted on a carriage so as to be scanned along a direction perpendicular to a transport direction of the recording medium.

In FIG. 12, there is shown an exploded/perspective view of one example of such a recording head. FIGS. 13A and 13B are sectional view of a major portion of this recording head. FIG. 13A is a sectional view of the recording head taken along the longitudinal direction of side walls. FIG. 13B is a sectional view of the recording head taken along the thickness direction of side walls. A plurality of grooves 102 are arranged in a piezoelectric ceramic plate 101 in a parallel manner. The respective grooves 102 are separated from each other by side walls 103. One end portion of each of the grooves 102 in the longitudinal direction is elongated up to one end surface of the piezoelectric ceramic plate 101, whereas the other end portion is not elongated up to the other end surface of this piezoelectric ceramic plate, and a depth thereof gradually becomes shallow. Also, an electrode 105 used to apply a driving electric field is formed on surfaces of both the side walls 103 on the opening side within each of the grooves 102 along the longitudinal direction.

A cover plate 107 is jointed via an adhesive agent 109 to the grooves 102 of the piezoelectric ceramic plate 101 on the opening side. This cover plate 107 has an ink chamber 111 that constitutes a concave portion which is communicated to the shallow other end portion of each of the grooves 102 and an ink supply port 112 that is penetrated through a bottom portion of this ink chamber 111 along a direction opposite to the direction of the grooves 102.

A nozzle plate 115 is jointed on an end surface of a joint member made by the piezoelectric ceramic plate 101 and the cover plate 107, at which the grooves 102 are opened. Nozzle openings 117 are formed in the nozzle plate 115 at such positions located opposite to the respective grooves 102.

It should be noted that a wiring board 120 is fixed on such a surface of the piezoelectric ceramic plate 101, which is located opposite to the nozzle plate 115 and also opposite to the cover plate 107. A wiring line 122 which is electrically connected to each of the electrodes 105 by employing a bonding wire 121 or the like is formed on the wiring board 120. A driver voltage may be applied via this wiring line 122 to the electrode 105.

In the recording head constituted in this manner, when ink is filled from the ink supply port 112 into the respective grooves 102 and a predetermined driving electric field is applied via the electrode 105 to the side walls 103 on both sides of a predetermined groove 102, the side walls 103 are deformed, so that a capacity formed within this predetermined groove 102 is change. As a result, the ink filled inside the grooves 102 may be jetted from the nozzle opening 117.

For example, as shown in FIG. 14, in the case where ink is jetted from a nozzle opening 117 corresponding to a groove 102*a*, a positive driving voltage is applied to both electrodes 105*a* and 105*b* provided in the groove 102*a*, and also electrodes 105*c* and 105*d* located opposite to these electrodes 105*a* and 105*b* are grounded. As a consequence, a driving electric field directed to the groove 102*a* is effected to the side walls 103*a* and 103*b*. When this driving electric field is positioned perpendicular to the polarization direction of the piezoelectric ceramic plate 101, both the side walls 103*a* and 103*b* are deformed along the direction of the groove 102*a* due to the piezoelectric thickness slip effect, so that the capacity defined inside the groove 102*a* is reduced to there by increase pressure. Thus, the ink may be jetted from the nozzle opening 117.

However, since such a head chip employs a large amount of high-cost ceramic, there is a problem in that the manufacturing cost of the head chip is high.

To solve such a problem, Japanese Patent Examined Publication No. Hei 6-6375 has proposed such a head chip which is manufactured by the plate shaped board made of glass, piezoelectric ceramic plate made by arranging the pressure chambers in the array form on this plate-shaped board, and ink chamber plate made of glass.

In accordance with this head chip, since both the plate-shaped board and the ink chamber plate are made of low-cost glass materials, this head chip can be manufactured in low cost and also the manufacturing time can be shortened.

However, the above-explained head chip with employment of the glass board owns such a problem in that since the electrode for applying the voltage to the piezoelectric ceramic plate has to be formed by way of the oblique vapor deposition, the manufacturing cost is increased.

Also, when the wiring lines electrically conducted to this electrode are extracted, these wiring lines are processed by metal plating such as nickel plating or gold plating, and thereafter the metal plated-wiring lines has to be cut one by one by using a laser. Thus, there is another problem in that the process step becomes cumbersome, and the manufacturing cost is increased.

Furthermore, even when the wiring lines are directly formed on the glass board by way of the metal plating, there is another problem in that the fitting characteristic is deteriorated, and thus, the formed wiring lines may readily peel off from the glass board.

SUMMARY OF THE INVENTION

The present invention has been made to solve such problems, and therefore, has an object to provide a method of manufacturing a head chip, while manufacturing cost is reduced, and also a manufacturing step is simplified.

In order to solve the above problems, according to a first aspect of the present invention, there is provided a head chip in which: partition walls made of piezoelectric ceramic are arranged on two upper and lower sheets of a first board and a second board with predetermined intervals; chambers are defined between the respective partition walls; a driver voltage is applied to electrodes provided on side surfaces of the partition walls to change the capacity in the chambers; and the ink filled in the chambers is jetted from nozzle openings, characterized in that:

the first board and the second board are formed of a dielectric material, and also wiring lines, which are electrically conducted to the electrodes and elongated to the outside of the end portions of the partition walls in the longitudinal direction, are provided on the surface of either one of the first board and the second board; and Further, the wiring lines include an inorganic conductive film as the lowermost layer and metal films formed thereon.

According to a second aspect of the present invention, in the first aspect of the present invention, there is provided a head chip characterized in that the dielectric material is glass.

According to a third aspect of the present invention, in the first or second aspect of the present invention, there is provided a head chip characterized in that the inorganic conductive film is made of at least one sort of material selected from the group consisting of ITO, $SnO_2$, ZnO, and ATO.

According to a fourth aspect of the present invention, in the first or second aspects of the present invention, there is provided a head chip characterized in that the inorganic conductive film is elongated between one of the first board and the second board and end portions of the partition walls in the width direction, and also end portion of the elongated inorganic conductive film in the width direction and the electrodes are electrically conducted to each other.

According to a fifth aspect of the present invention, in the fourth aspect of the present invention, there is provided a head chip characterized in that the thickness of the inorganic conductive film is set to be equal to or less than 3 $\mu$m.

According to a sixth aspect of the present invention, in the first or second aspects of the present invention, there is provided a head chip characterized in that the electrodes and the metal films are formed by selective electroless plating.

According to a seventh aspect of the present invention, in the first or second aspects of the present invention, there is provided a head chip characterized in that the electrodes and the metal films are formed of a nickel layer and a gold layer.

According to a eighth aspect of the present invention, in the first or second aspects of the present invention, there is provided a head chip characterized in that a nozzle plate having the nozzle openings is provided at the end portions of the partition walls in the longitudinal direction, at which the chambers are opened, and also an ink chamber that communicates with the respective chambers is provided on the other end portion side of the partition walls.

According to a ninth aspect of the present invention, in the eighth aspect of the present invention, there is provided a head chip characterized in that the nozzle plate is formed of a dielectric material.

According to a tenth aspect of the present invention, in the first or second aspects of the present invention, there is provided a head chip characterized in that the partition walls are formed by jointing two sheets of piezoelectric ceramic having different polarization direction in the thickness direction.

According to a eleventh aspect of the present invention, in the first or second aspects of the present invention, there is provided a head chip characterized in that the regions corresponding to the chambers are provided with concave portions in one of the first board and the second board, which is provided with the wiring lines.

According to a twelfth aspect of the present invention, in the first or second aspects of the present invention, there is provided a head chip characterized in that a driver circuit is provided with the region corresponding to the wiring lines in one of the first board and the second board, which is provided with the wiring lines.

According to a thirteenth aspect of the present invention, in the first or second aspects of the present invention, there is provided a head unit characterized in that the head unit comprises the head chip as claimed in any one of claims 1 to 12 and a head holder that mounts the head chip.

According to a fourteenth aspect of the present invention, in the thirteenth aspect of the present invention, there is provided a head unit characterized in that the head holder may detachably hold an ink cartridge in which ink is stored.

According to the present invention, while the board made of the dielectric material is employed, the inorganic conductive film, that has the better fitting characteristic with the dielectric material, is provided at the lowermost layer of the wiring line.

As a consequence, the manufacturing step can be made simple, and also the manufacturing cost can be reduced. Moreover, the wiring lines can be easily conducted to the electrodes without fail.

DETAILED DESCRIPTION OF THE PREFERRED EMBODIMENTS

Hereinafter, the present invention will be described in detail with reference to embodiments.

Figure 1:
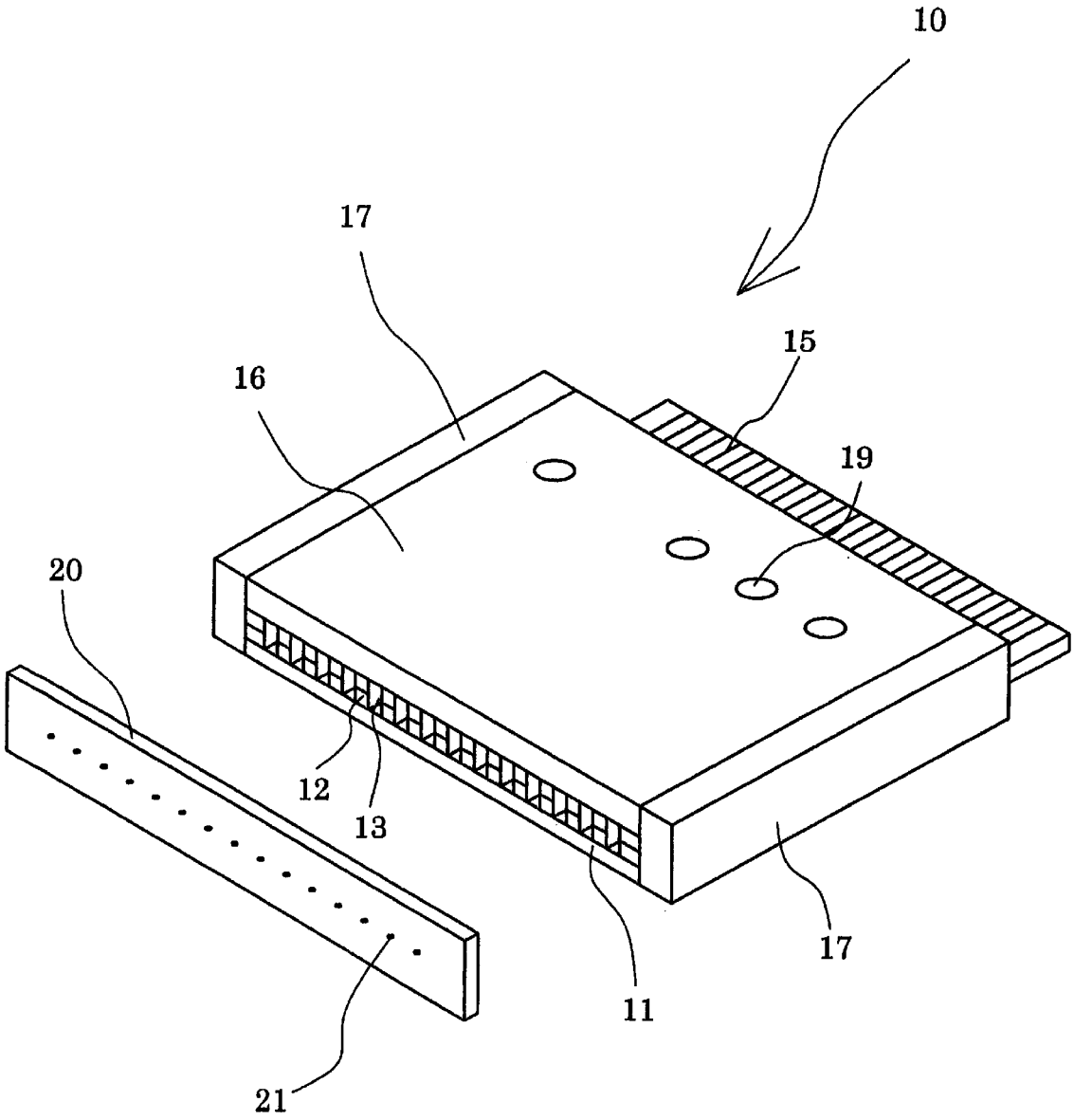
FIG. 1 is a perspective view showing a head chip according to an embodiment of the present invention.
Figure 2:
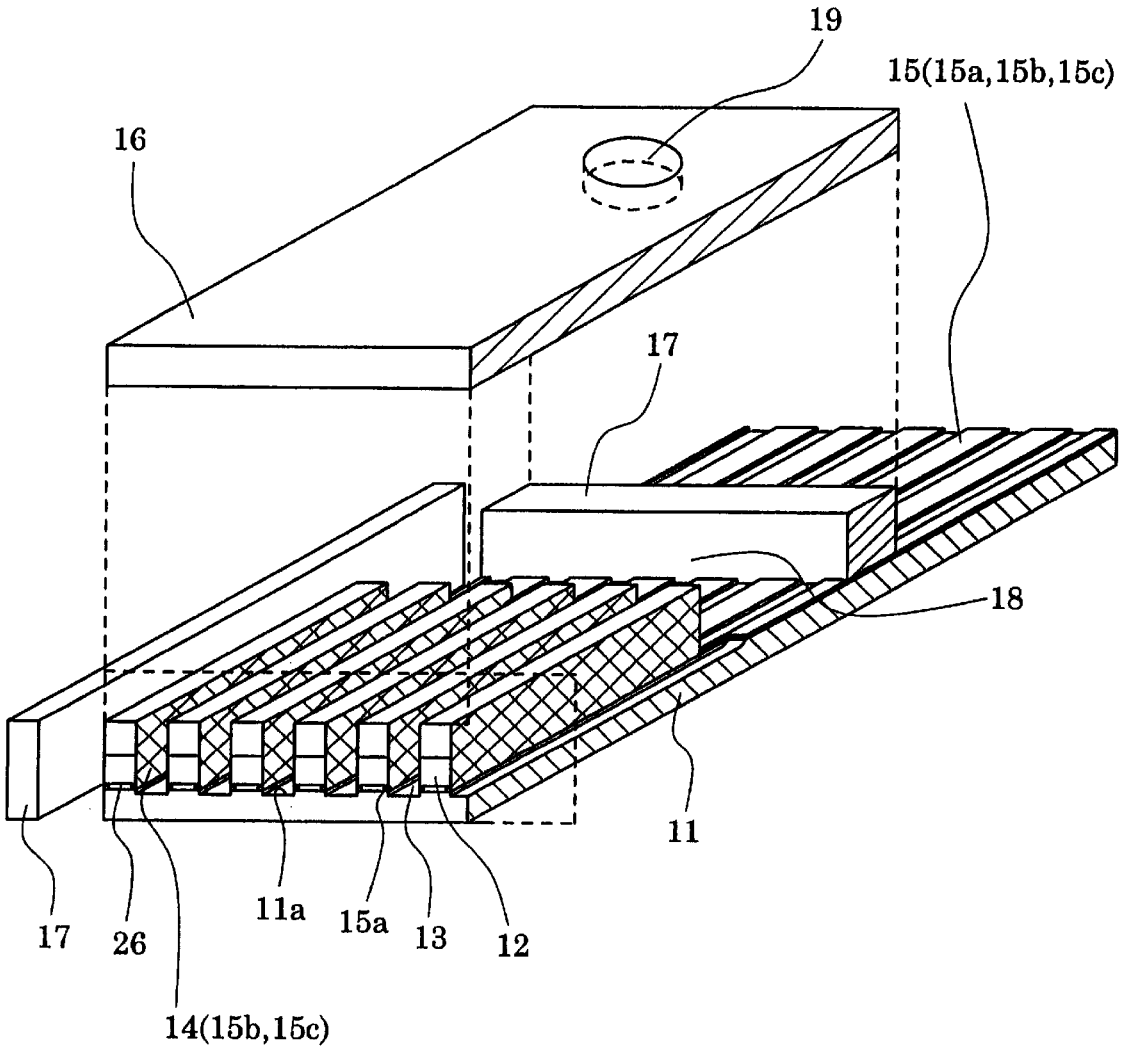
FIG. 2 is a perspective sectional view indicating the head chip according to the embodiment of the present invention.
Figure 3A:
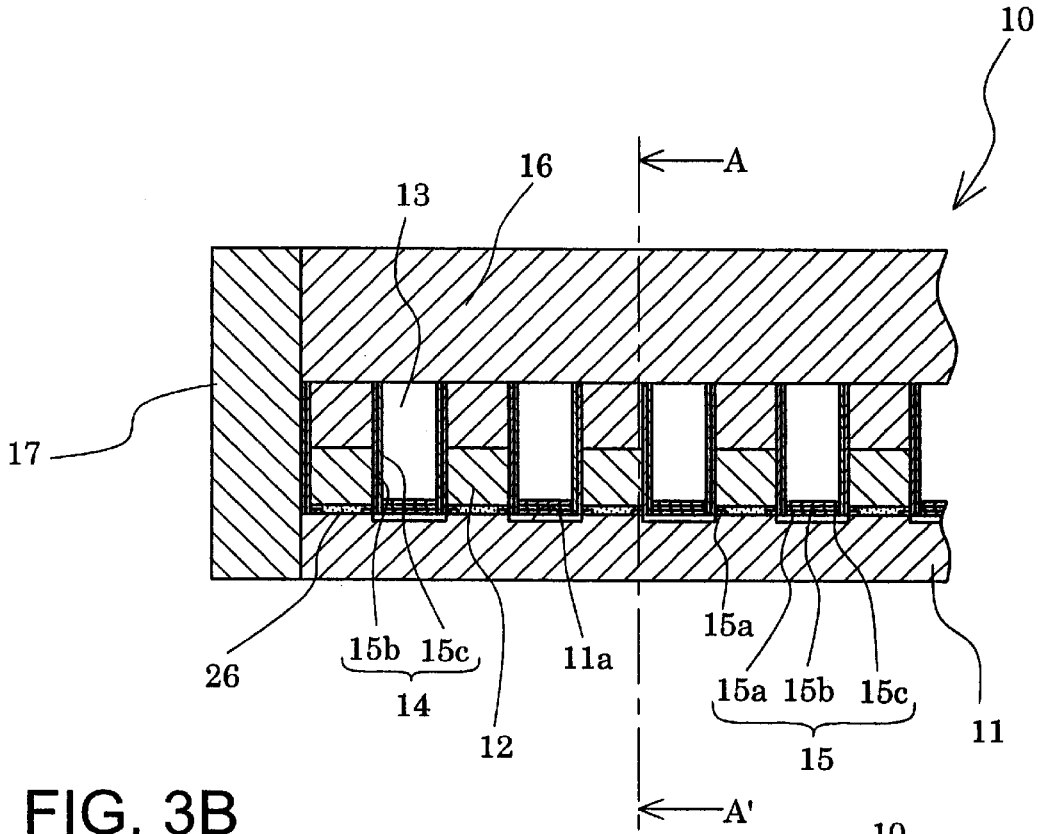
FIG. 3 is a sectional view representing the head chip according to the embodiment of the present invention, taken along a parallel-arranging direction of a chamber, and also a sectional view of the head chip, taken along a line A–A' thereof.
Figure 3B:
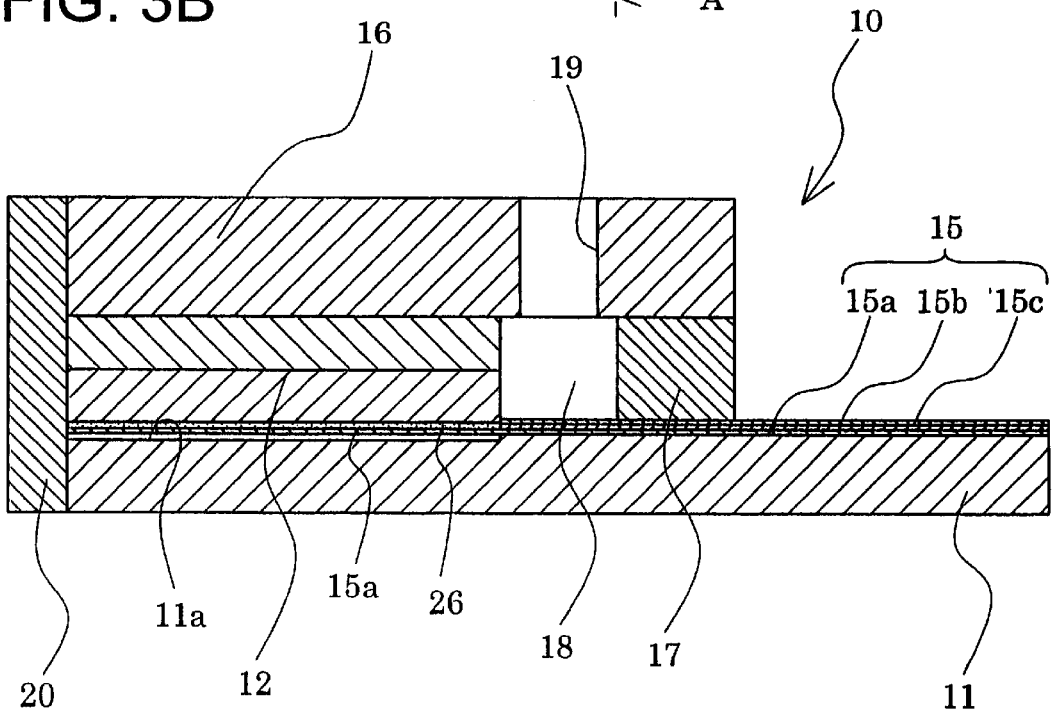

FIG. 1 is a perspective view indicating a head chip according to an embodiment of the present invention. FIG. 2 is a sectional perspective view of the head chip. FIG. 3A is a sectional view showing a chamber along a parallel-arranging direction, and FIG. 3B is a sectional view of the chamber, taken along a line A–A' of FIG. 3A.

As shown in the figure, a plurality of chambers 13, which are defined in a plurality of partition walls 12 made of piezoelectric ceramic by arranging in parallel the partition walls 12 with predetermined intervals, are provided on a plate-shape glass board 11.

A piezoelectric ceramic plate is aligned and adhered to one side of the glass board 11 by an adhesive agent 26, agent the partition walls 12 are formed by cutting out the piezoelectric ceramic plate using, for example, a disk-shape dice cutter. At this time, in order to cut out the piezoelectric ceramic plate completely, the surface of the glass board 11 is ground by the dice cutter, and concave portions 11*a* corresponding to the respective chambers 13 are formed in the glass board 11. Of course, only the piezoelectric ceramic plate is completely cut out and the concave portions 11*a* may not be formed. Also, each of the partition walls 12 may be adhered with predetermined intervals.

This piezoelectric ceramic plate is formed by jointing two piezoelectric ceramic plates having different polarization direction in the thickness direction. Further, electrodes 14 for applying driving electric field are formed on the entire surface of the side surfaces of the partition walls 12, which are surfaces of the respective chambers 13.

Further, wiring lines 15 are provided on inner sides of end portions of the respective partition walls 12 in the longitudinal direction on the glass board 11. The wiring line 15 has an inorganic conductive film 15*a* as the lowermost layer.

As the inorganic conductive film 15*a*, ITO (oxide of indium and tin), $SnO_2$, ZnO, ATO (oxide of antimony and tin) or the like may be given. In this embodiment, ITO is used as the inorganic conductive film 15*a*. The wiring line 15 is formed of at least one layer of a metal film formed by selective electroless plating on the inorganic conductive film 15*a*. In this embodiment, the wiring line 15 is constituted of the inorganic conductive film 15*a* and two layers of a nickel metal film 15*b* and a gold metal film 15*c*.

In addition, although the electrode 14 is constituted of the nickel metal film 15*b* and the gold metal film 15*c*, which are formed together with the wiring line 15 on the side surface of the partition wall 12 by the selective electroless plating.

Here, the inorganic conductive film 15*a* is elongated along the chambers 13 defined on both sides between the glass board 11 and the respective partition walls 12, and the end portion of the inorganic conductive film 15*a* in the width direction is firmly in contact with the electrode 14. Thus, electrical conduction between the electrode 14 and the wiring line 15 is realized.

In the case where the inorganic conductive film 15*a* is elongated between the glass board 11 and the partition walls 12 as described above, if the inorganic conductive film 15*a* is too thick, adhesion malfunction is easy to occur when the partition walls 12 are adhered to the glass board 11. Thus, there is a fear that displacement, peeling, or the like occurs when the partition walls 12 are driven. Therefore, it is preferable that the inorganic conductive film 15*a* is made relatively thinner, and preferably made to 3 $\mu$m or less.

Figure 4:
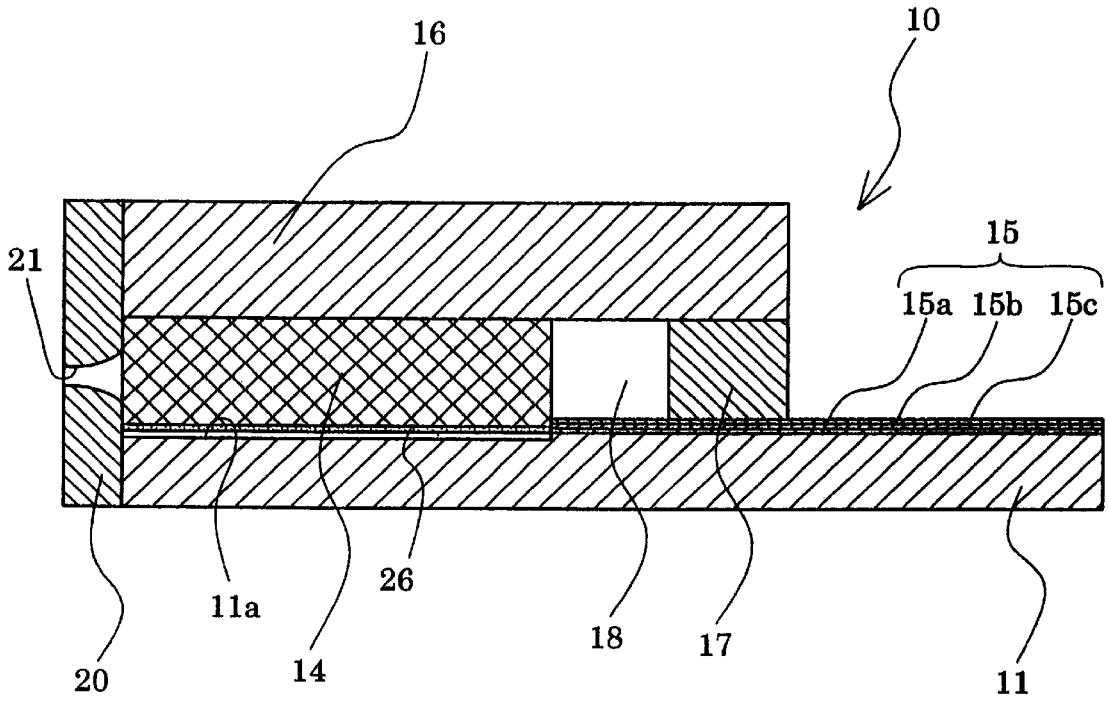
FIG. 4 is a sectional view showing another example of an inorganic conductive film according to the present invention, along a longitudinal direction of the chamber.

It should be noted that in this embodiment, the inorganic conductive film 15*a* elongated between the glass board 11 and the partition wall 12 is formed along the longitudinal direction of the partition wall 12, but the present invention is not limited thereto if the inorganic conductive film 15*a* can be electrically conducted to the electrode 14 provided on the side surface of the partition wall 12. Only a portion of the inorganic conductive film 15*a*maybe elongated along the longitudinal direction. For instance, as indicated in FIG. 4, the inorganic conductive film 15*a* is not elongated between the glass board 11 and the partition wall 12, but may be alternatively provided so as to be in contact with the end surface of the partition wall 12. In any cases, it is necessary that the electrode 14 is surely and electrically conducted with the wiring lines 15. It should be noted that FIG. 4 is a sectional view showing the chamber 13 along the longitudinal direction, and the electrode 14 is continued to the metal films 15*b* and 15*c* at the end portion thereof in the longitudinal direction.

On the other hand, a cover plate 16 formed of plate-shape glass is jointed to the partition walls 12 on the side opposite to the glass board 11. Further,guide walls 17 made of plastic,for example, are adhered to both side surfaces of the glass board 11 and to the inner portions of the glass board 11 on the side of the end portions of the respective partition walls 12 in the longitudinal direction on the glass board 11 by the adhesive agent or the like. Then, an ink chamber 18 that communicates with the respective chambers 13 is defined by the guide walls 17 and partition walls 12 on the glass board 11.

Further, the cover plate 16 is provided with an ink supply port 19, which supplies ink to the ink chamber 18 defined on the glass board 11 and is bored through the cover plate 16 in the thickness direction.

It should be noted that the ink supply port 19 of the cover plate 16 is formed by sandblasting in this embodiment.

Here in this embodiment, the respective chambers 13 are divided into groups corresponding to respective colors consisting of black (B), yellow (Y), magenta (M), and cyan (C), and four ink chambers 18 and four ink supply ports 19 are provided, respectively.

Further, a nozzle plate 20 is jointed to the end surfaces of the partition walls 12, which are formed flush with the end surface of the glass board 11, and nozzle openings 21 are pierced in the nozzle plate 20 at the positions opposite to the respective chambers 13.

This nozzle plate 20 may be formed by, for example, plate-shape metal, plastic, glass, or polyimide film. Further, although not shown in the figure, a water repelling film having a water repelling property is provided to the surface of the nozzle plate 20, which is opposite to a subject to be printed, in order to prevent adhesion of ink or the like.

Furthermore, a manufacturing method of a head chip in accordance with the above embodiment will be explained in detail. It should be noted that FIG. 5 and FIG. 7 are top views showing manufacturing steps of the head chip. FIG. 6 and FIG. 8 are cross sectional views of the chamber 13 along the parallel-arranging direction, which correspond to the manufacturing steps of FIG. 5 and FIG. 7, respectively.

Figure 5A:
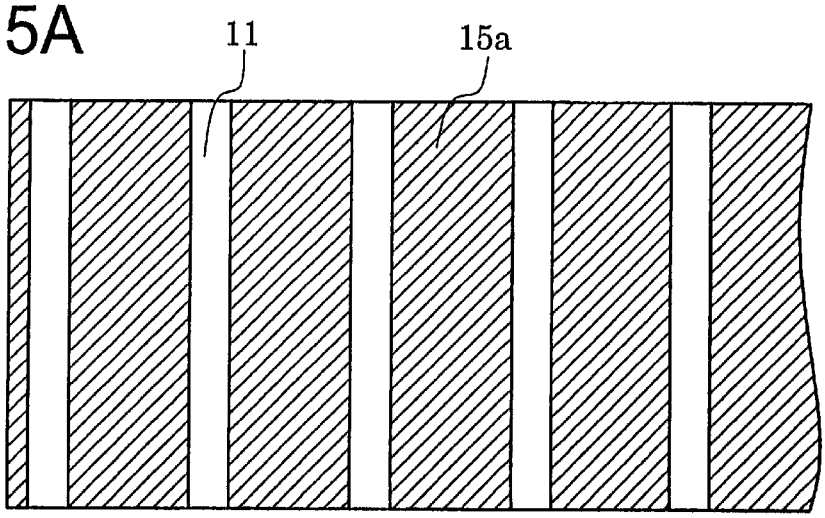
FIG. 5 is a top view showing a manufacturing method of the head chip according to the embodiment of the present invention.
Figure 6A:
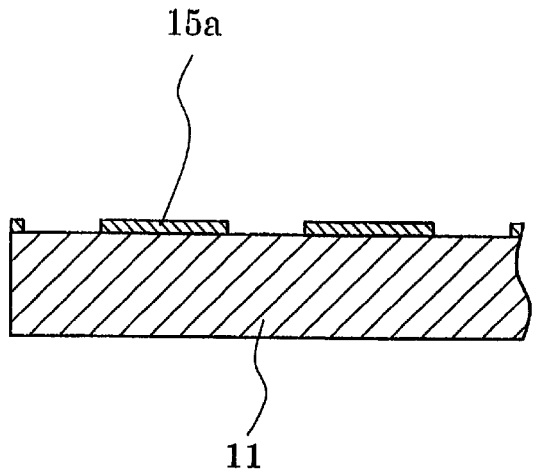
FIG. 6 is a sectional view representing the head chip corresponding to the respective manufacturing steps of FIG. 5 along the parallel-arranging direction of the chamber.

First, as shown in FIG. 5A and FIG. 6A, an ITO film that is the inorganic conductive film 15*a* is formed on the plate-shape glass board 11 and the ITO film is patterned with a predetermined shape, here, with an interval that is slightly wider than that of the chamber 13.

There is no limitation on the forming method of the inorganic conductive film 15*a*. For example, after the inorganic conductive film 15*a* is formed by a sputtering method, an application method or the like, it may be patterned with photolithography or the like.

In addition, if the inorganic conductive film 15*a* is too thick, adhesion malfunction occurs when the partition walls 12 are adhered to the glass board 11 in the following step. Thus, there is a fear that displacement, peeling, or the like of the partition walls 12 occurs when the partition walls 12 are driven. Therefore, it is preferable that the inorganic conductive film 15*a* is made relatively thinner, and preferably made to 3 μm or less.

Figure 5B:
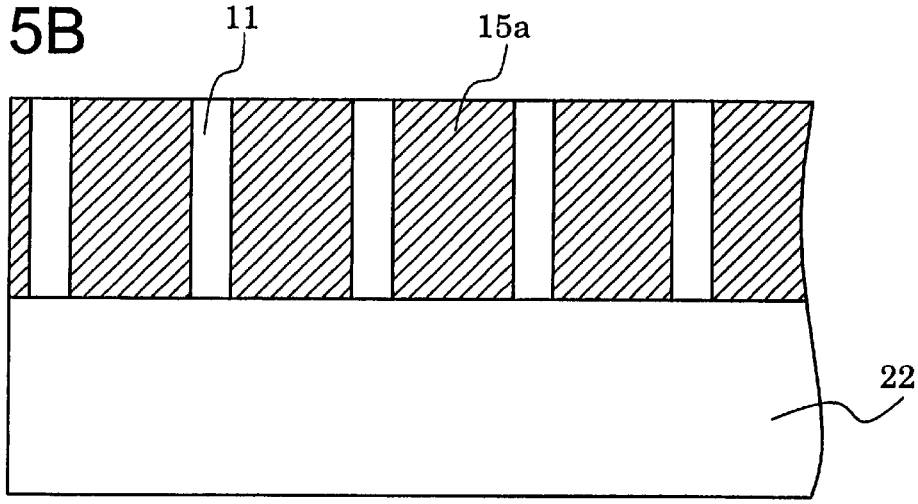
Figure 6B:
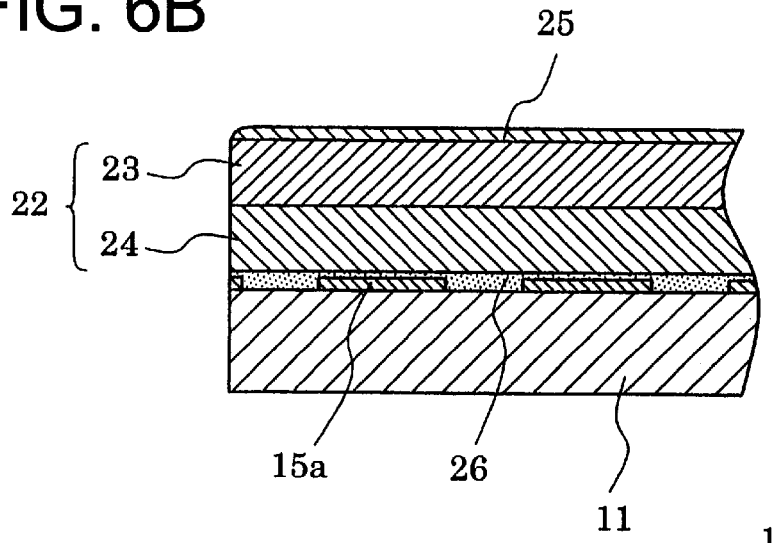

Next, as shown in FIG. 5B and FIG. 6B, a piezoelectric ceramic plate 22 in which surfaces other than a bonding surface are previously coated with a resist 25 is adhered onto the inorganic conductive film 15*a* by the adhesive agent 26. This piezoelectric ceramic plate 22 is formed by jointing two sheets of piezoelectric ceramic plates 23 and 24 having different polarization direction in the thickness direction, the surfaces other than the bonding surface are coated with the resist 25, and then, the piezoelectric ceramic plate 22 is adhered to the glass board 11 by the adhesive agent 26. It should be noted that the resist 25 may be provided after the piezoelectric ceramic plate 22 is adhered to the glass board 11.

Figure 5C:
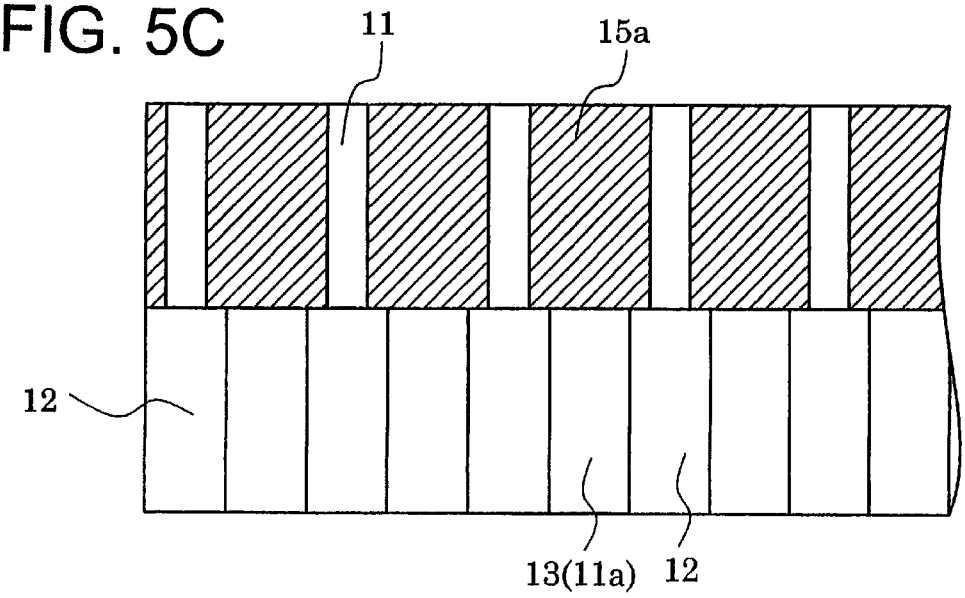
Figure 6C:
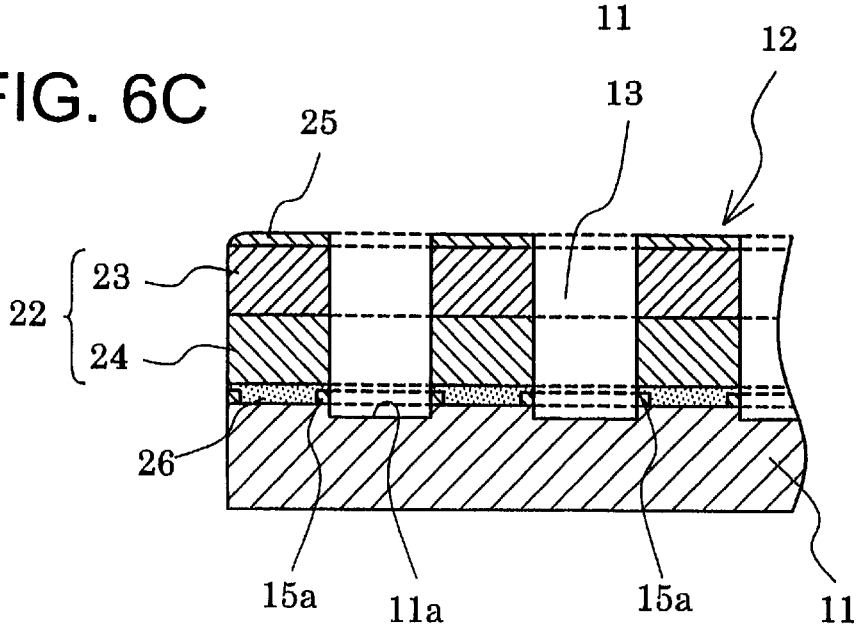

Thereafter, as shown in FIG. 5C and FIG. 6C, the piezoelectric ceramic plate 22 is cut out to form the partition walls 12 and the chambers 13. In this embodiment, for example, the piezoelectric ceramic plate 22 is cut out in the thickness direction with the width that is narrower by a predetermined width than the width of the inorganic conductive film 15*a* by using the disk-shape dice cutter, to thereby form the partition walls 12 and the chambers 13.

At this time, the inorganic conductive film 15*a* is cut out to the surface of the glass board 11 in order that the inorganic conductive film 15*a* provided on the glass board 11 is not electrically conducted within the chambers 13. Thus, the concave portions 11*a* are formed. Of course, the inorganic conductive film 15*a* may be previously patterned into the cut-out condition.

Further, when the partition walls 12 are formed, since the piezoelectric ceramic plate 22 is cut out with the width that is narrower by a predetermined width than the width of the inorganic conductive film 15*a*, the inorganic conductive film 15*a* remains between both end portions in the width direction of the partition walls 12 and the glass board 11 along the longitudinal direction, and the side surfaces are exposed. The inorganic conductive films 15*a* formed on both sides of the respective chambers 13 are continuous with the inorganic conductive films 15*a* that become the wiring lines 15 at the rear of the partition walls 12 as shown in FIG. 6C.

Figure 7A:
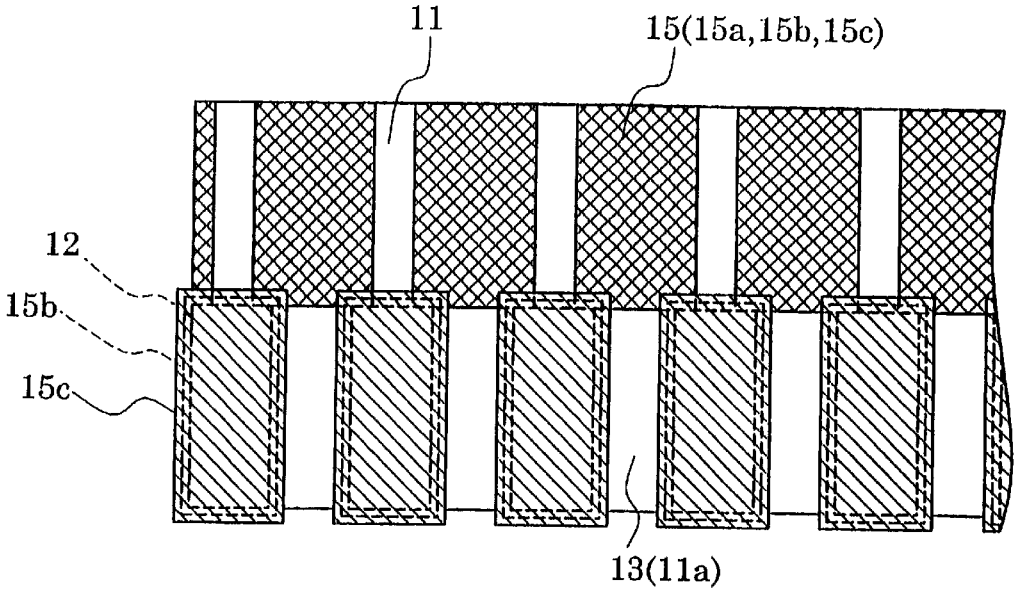
FIG. 7 is a top view showing the manufacturing method of the head chip according to the embodiment of the present invention.
Figure 8A:
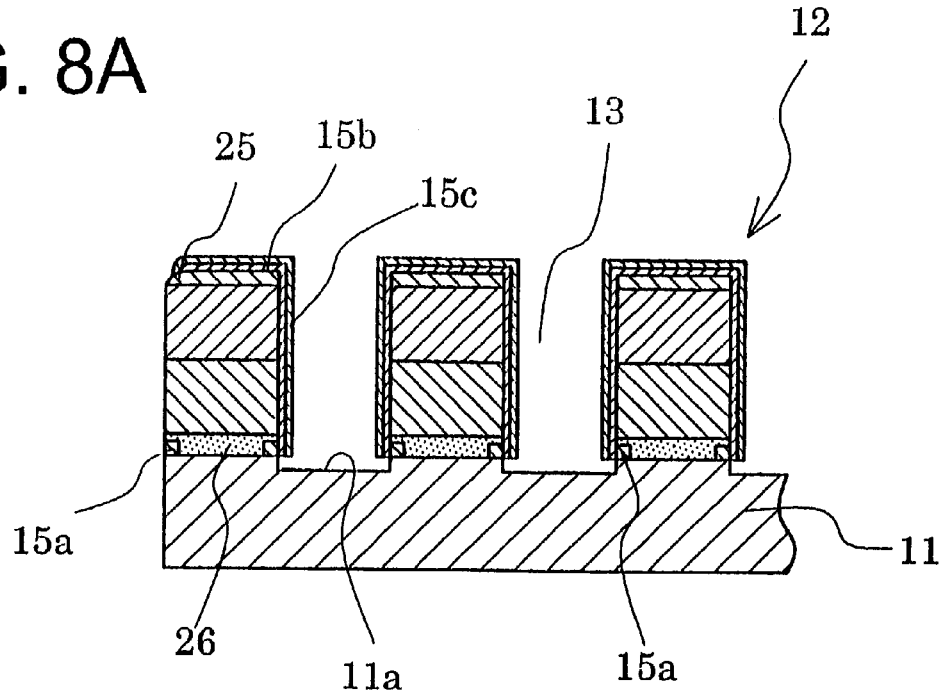
FIG. 8 is a sectional view representing the head chip corresponding to the respective manufacturing steps of FIG. 7 along the parallel-arranging direction of the chamber.

Next, as shown in FIG. 7A and FIG. 8A, a starting catalyst containing palladium, platinum or the like is adsorbed over the entire surfaces of both the partition walls 12 and the inorganic conductive films 15*a*, namely surfaces other than the surface of the glass board 11. Thereafter, the nickel metal film 15*b* and the gold metal film 15*c* are formed by selective electroless plating.

The wiring line 15 of three layers, that is constituted of the inorganic conductive film 15*a*, the nickel metal film 15*b* and the gold metal film 15*c*, is formed at the rear of the partition wall 12 by this selective electroless plating, and the two layers of the nickel metal film 15*b* and the gold metal film 15*c* are formed over the entire surface of the partition wall 12. Further, the metal films 15*b* and 15*c* provided over the entire surface of the partition wall 12 are electrically conducted to the inorganic conductive film 15*a* provided between the partition wall 12 and the glass board 11 at the exposed side surface.

Figure 7B:
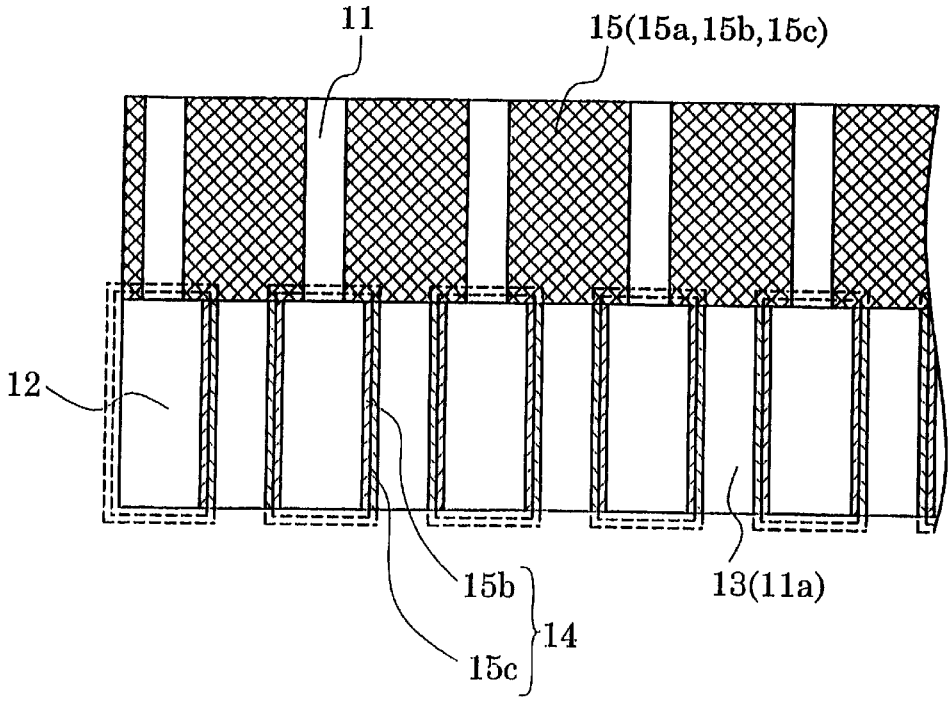
Figure 8B:
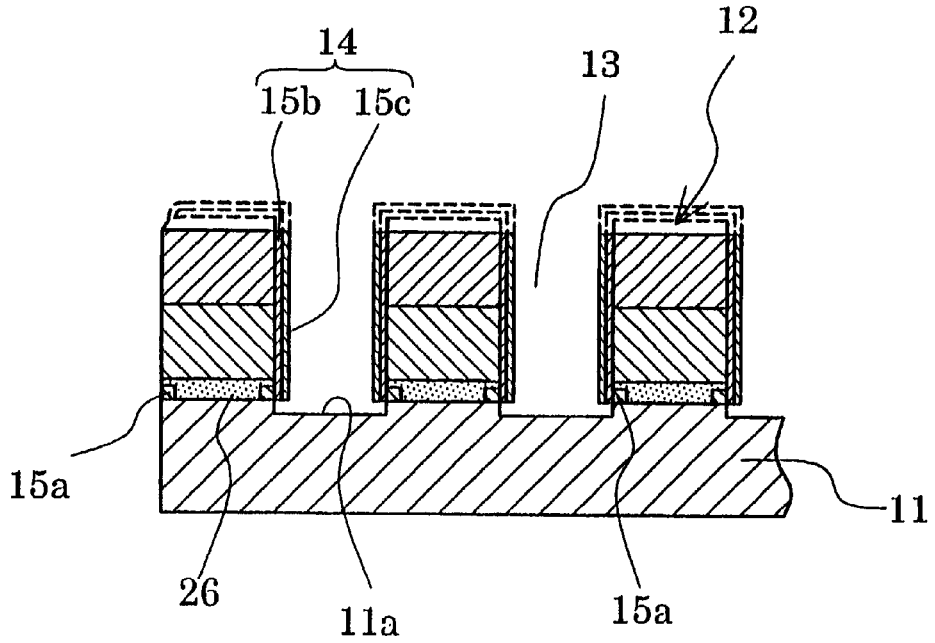

Next, as shown in FIG. 7B and FIG. 8B, the resist 25, which is formed on both the upper surface of the partition wall 12 and both end surfaces of the partition wall 12 in the longitudinal direction, and also unnecessary metal films 15*b* and 15*c* formed on the resist 25 are lifted off. As a result, such an electrode 14, which is not short-circuited on both the side surfaces of the partition wall 12 and which is constructed of two layers made of the nickel metal film 15*b* and the gold metal film 15*c*, is formed on the side surface of the partition wall 12.

As previously explained, both the metal films 15*b* and 15*c* which constitute the electrode 14 formed in this manner are electrically conducted with the inorganic conductive film 15*a* on the exposed side surfaces thereof. In other words, the electrode 14 is mutually and electrically conducted via the inorganic conductive film 5*a* to the wiring line 15.

Thereafter, as indicated in FIG. 1 to FIG. 3, the guide wall 17 made of plastic is fixed on the rear portion of each of the partition walls 12, and also both the end surfaces of the glass board 11 along the parallel-arranging direction of the partition walls 12 by using the adhesive agent or the like, so that the ink chamber 18 is defined on the glass board 11. Then, the cover plate 16 is fixed by using the adhesive agent or the like on the side opposite to the glass board 11 of the partition wall 12, and also the nozzle plate 20 having a plate shape, in which the nozzle openings 21 are pierced, is fixed on the side end surface of the partition wall 12 of the glass board 11 with respect to each of the chambers 43. Then, the outer shape of the resultant head chip is processed by dicing, and thus, a head chip 10 may be manufactured.

As explained above, in this embodiment, the inorganic conductive film 15*a* is patterned on the glass board 11, and the selective electroless plating is performed on this inorganic conductive film 15*a*. As a result, the wiring lines 15 can be readily manufactured, and also the fitting characteristic between the glass board 11 and the wiring lines 15 can be improved.

Also, since the electrode 14 can be formed at the same time when the wiring lines 15 are formed, the entire manufacturing steps can be made simpler, and further, the manufacturing cost can be reduced.

Further, the manufacturing cost can be reduced by using a large amount of low-cost glass.

Furthermore, driving principle etc. of the head chip 10 are as described in the prior art, and therefore, the description thereof is omitted here.

Figure 9:
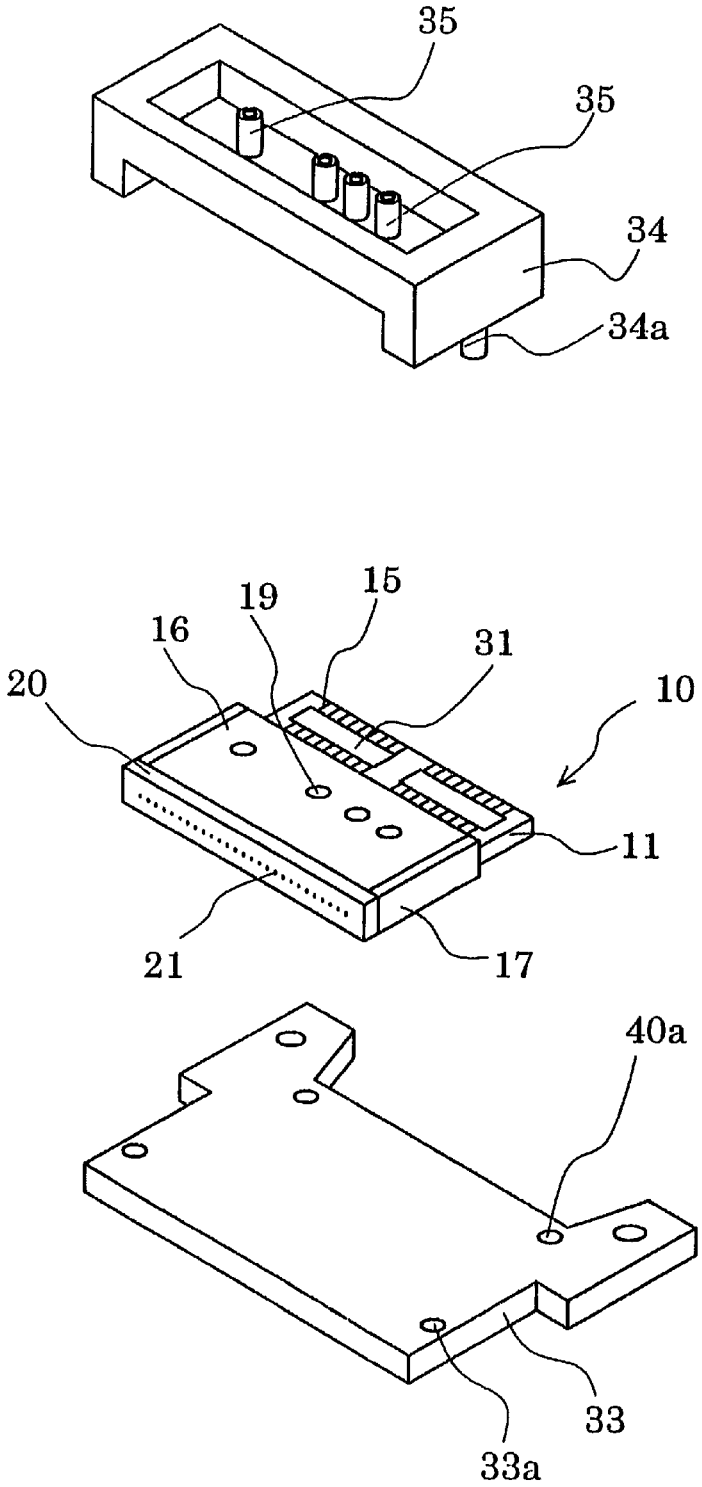
FIG. 9 is a perspective view indicating an assembly of a unit with employment of the head chip according to the embodiment of the present invention.

FIG. 9 is an exploded perspective view indicating a head chip unit on which the above-explained head chip 10 is mounted.

As illustrated in FIG. 9, a driver circuit 31 such as an integrated circuit for driving the head chip 10 is directly connected to the wiring line 15, and this driver circuit 31 is mounted on the glass board 11 of the head chip 10. Also, a base plate 33 made of aluminum is assembled on the side of the glass board 11, and a head cover 34 is assembled on the side of the cover plate 16 in the head chip 10. The base plate 33 is fixed to the head cover 34 such that an engaging shaft 34*a* of the head cover 34 is engaged with an engaging hole 33*a* of the base plate 33, and the head chip 10 is sandwiched by both the base plate 33 and the head cover 34. An ink conducting path 35 is formed on the head cover 34, and this ink conducting path 35 is communicated with each of the ink supply ports 19 of the cover plate 16.

Also, such a head chip unit 40 may be assembled with, for example, a tank holder, which detachably holds an ink cartridge, to be used.

Figure 10A:
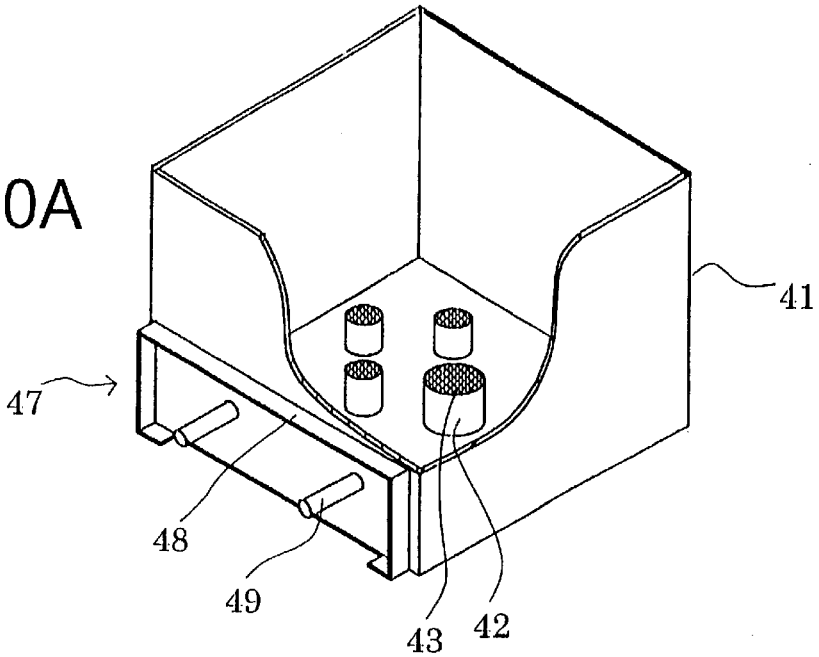
FIG. 10 is a perspective view indicating an assembly of a unit with employment of the head chip according to the embodiment of the present invention.
Figure 10B:
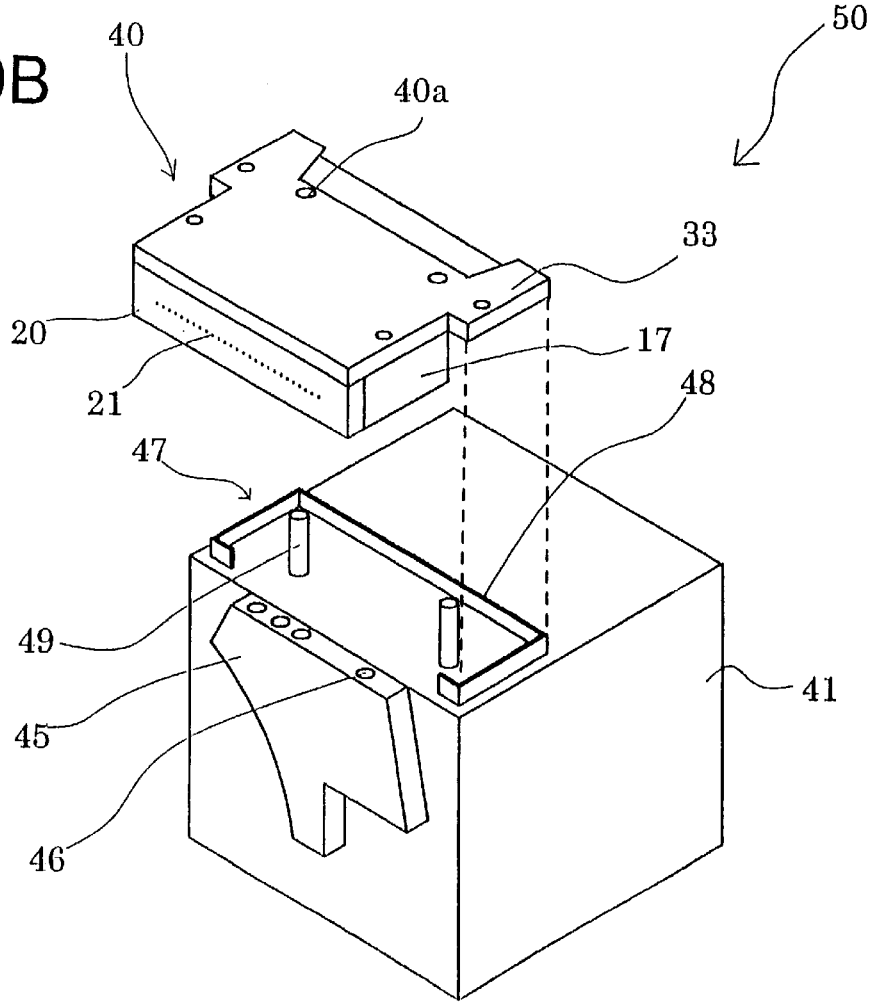

FIG. 10A shows an example of such a tank holder. FIG. 10B shows the tank holder 41 and the head chip unit 40 which is assembled with the tank holder 41. The tank holder 41 shown in FIG. 10 is formed to have substantially a box shape whose one surface is opened, and an ink cartridge (not shown) may be detachably held. A coupling portion 42 is provided on an upper surface of a bottom wall, and is coupled to the ink supply port 19 corresponding to an opening portion formed in the bottom portion of the ink cartridge. A plurality of the coupling portions 42 are provided with respect to each of color ink, for instance, black (B) ink, yellow (Y) ink, magenta (M) ink, and cyan (C) ink. An ink flow path (not shown) is formed inside the coupling portion 42, and a filter 43 is provided at a tip portion of the coupling portion 42 which constitutes an opening of this ink flow path. The ink flow path forced inside the coupling portion 42 is communicated to the rear surface of the bottom wall. The respective ink flow paths are communicated to a head coupling port 46 which is opened in the partition wall of a flow path board 45 via an ink flow path (not shown) which is provided within the flow path board 45 provided on the side of the rear surface of the tank holder 41. This head coupling port 46 is opened on the side of the side surface of the tank holder 41, and a head chip unit holding portion 47 which holds the above-described head chip unit 40 is provided on the bottom portion of this partition wall. In the head chip unit holding portion 47, there are provided a surrounding wall 48 and an engaging shaft 49. The surrounding wall 48 surrounds the driver circuit 31 provided on the glass board 11, and is formed into substantially a U-shape and positioned in an upright manner. The engaging shaft 49 is engaged with an engaging hole 40*a* formed in the base plate 33 of the head chip unit 40 provided inside the surrounding wall 48.

As a consequence, the head chip unit 40 is mounted on this head chip unit holding portion 47, so that a head unit 50 can be completed. At this time, the ink conducting path 35 formed in the head cover 34 is coupled to the head coupling port 46 of the flow path board 45. As a result, the ink which is conducted from the ink cartridge via the coupling portion 42 of the tank holder 41 is conducted via the ink flow path formed in the flow path board 45 into the ink conducting path 35 of the head chip unit 40, so that this ink is filled into both the ink chamber 18 and the chambers 13.

Figure 11:
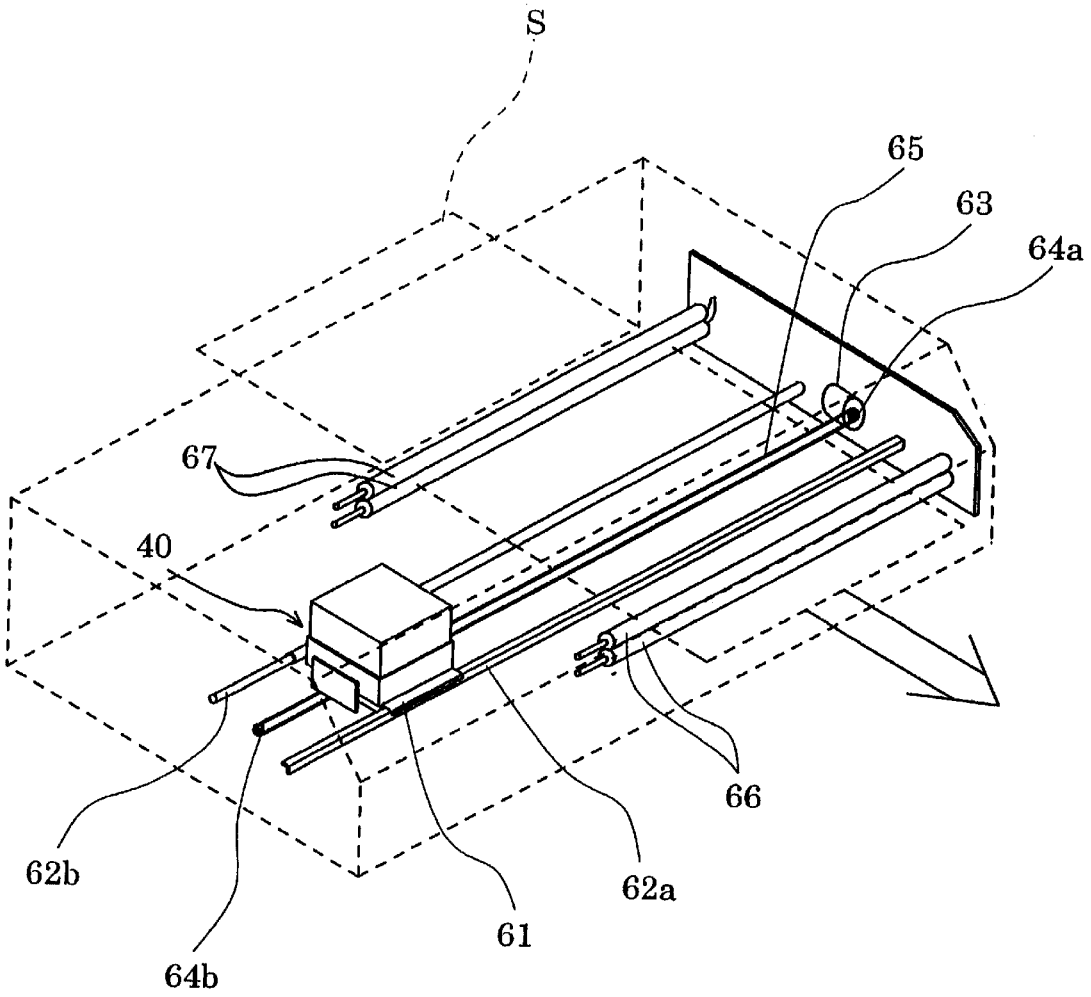
FIG. 11 is a perspective view showing a use mode of the unit with employment of the head chip according to the embodiment of the present invention.
Figure 12:
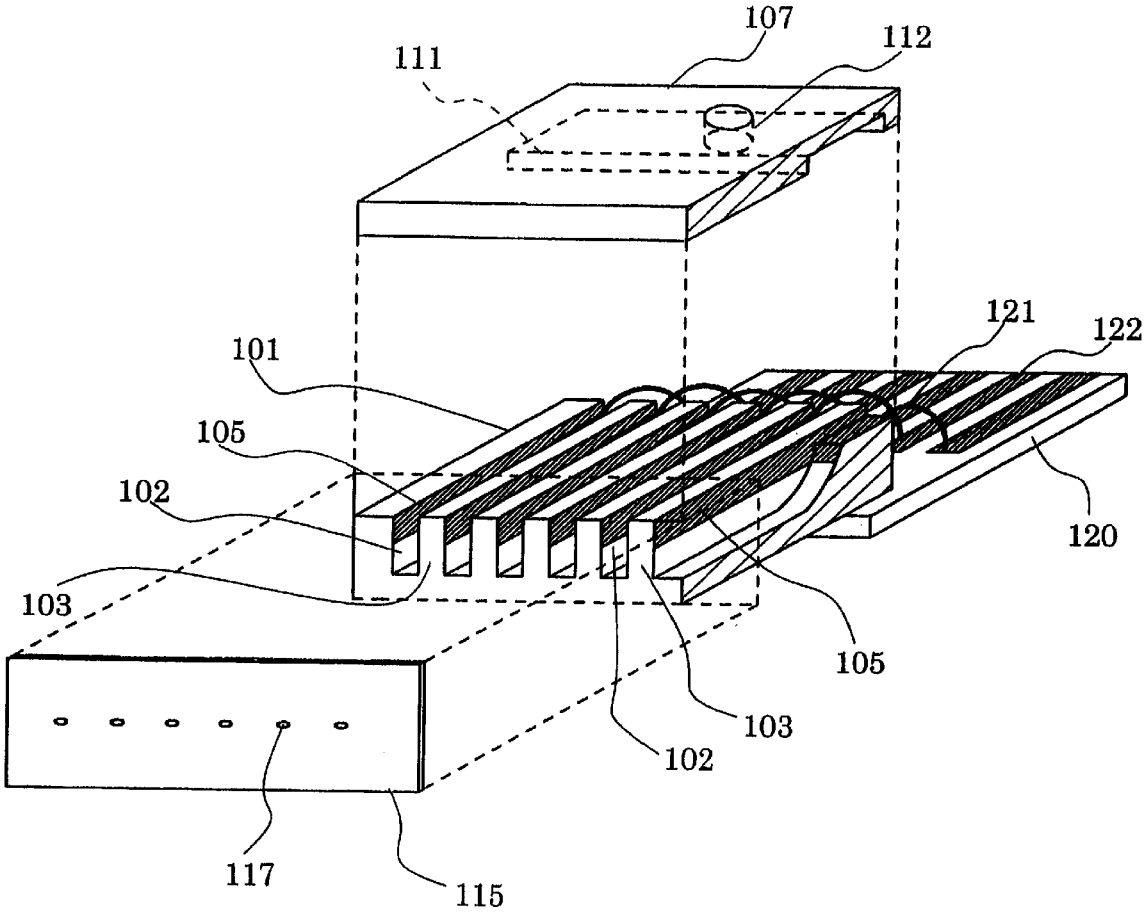
FIG. 12 is an exploded perspective view schematically indicating a recording head in accordance with a conventional technique.
Figure 13A:
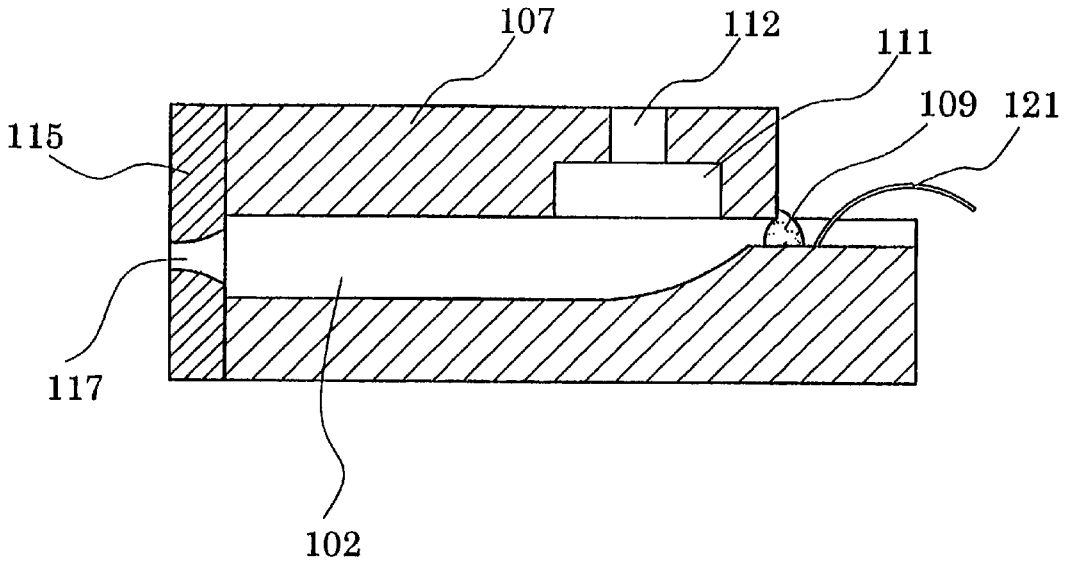
FIG. 13A PRIOR ART
FIG. 13 is a sectional view schematically indicating the recording head in accordance with the conventional technique.
Figure 13B:
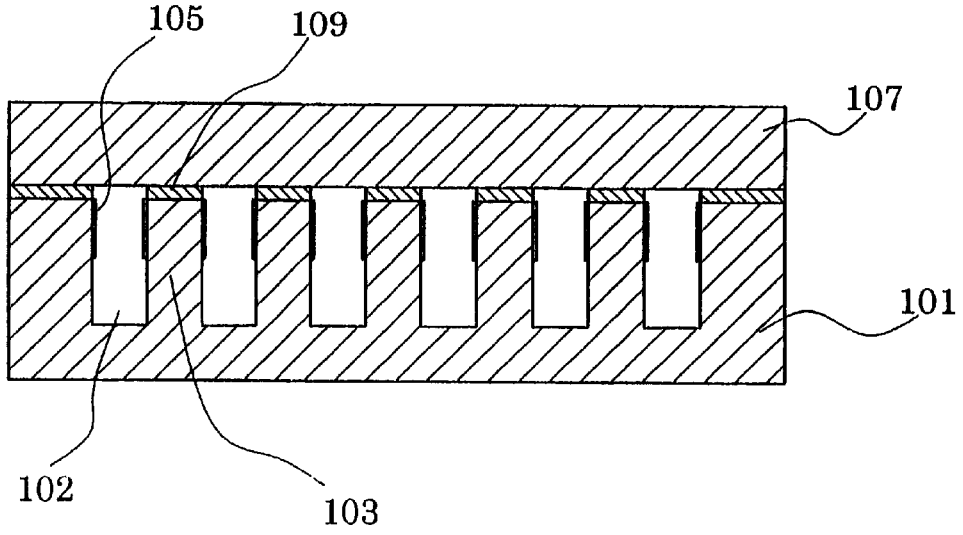
FIG. 13B PRIOR ART
Figure 14:
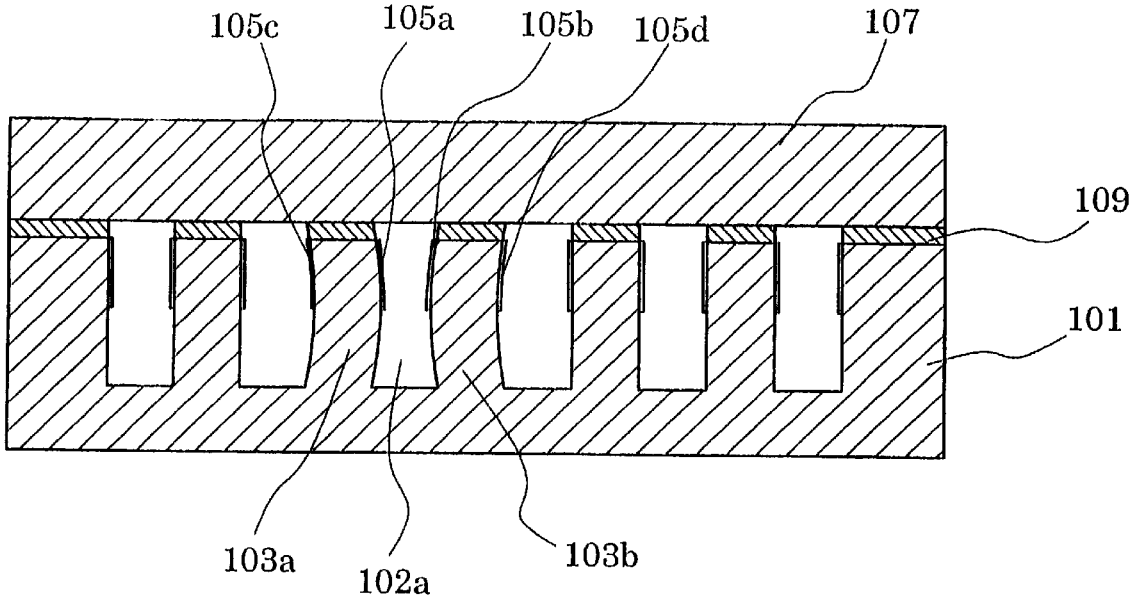
FIG. 14 is a sectional view schematically indicating the recording head in accordance with the conventional technique.

Such a head unit 50 is mounted on, for instance, a carriage of an ink-jet type recording apparatus to be used. FIG. 11 schematically shows an example of a use mode of the head unit 50.

As shown in FIG. 11, a carriage 61 is movably mounted on one pair of guider ails 62*a* and 62*b* along a shaft direction. This carriage 61 is transported by way of a timing belt 65 which is suspended between a pulley 64*a,* that is provided on one end side of the guide rail 62, and is coupled to a carriage driving motor 63, and another pulley 64*b* that is provided on the other side of this guide rail 62. A pair of transfer rollers 66 and 67 are provided along the guide rails 62*a* and 62*b* on both sides in a direction perpendicular to the transport direction of the carriage 6l. These transfer rollers 66 and 67 are used to transport a recording medium "S" located below the carriage 61 along a direction perpendicular to the transport direction of this carriage 61.

The above-explained head unit 50 is mounted on the carriage 61, and the above-explained ink cartridge may be detachably mounted on this head unit 50.

In accordance with such an ink-jet type recording apparatus, while the recording medium "S" is fed, the carriage 61 is scanned along the direction perpendicular to this medium feeding direction, so that both a character and an image can be recorded on this recording medium "S" by the head chip.

While the present invention has been described with the embodiment, the present invention is not limited to the construction described above.

As described above, according to the present invention, both the upper board and the lower board are formed by the dielectric material, and also, the inorganic conductive film is employed as the lowermost layer of the wiring lines which are electrically conducted to the electrode. Thus, the fitting characteristic between the wiring lines and the boards can be improved, and the manufacturing steps of the wiring lines can be made simple. Also, manufactured cost can be reduced.

Further, the inorganic conductive film is elongated between one of the upper and lower boards and the end portions of the partition walls in the width direction. Thus, the drawing out of the electrodes can be easily formed and also electrical conduction can be attained without fail.

What is claimed is:

1. A head chip in which: partition walls made of piezoelectric ceramic are arranged on two upper and lower sheets of a first board and a second board with predetermined intervals; chambers are defined between the respective partition walls; a driver voltage is applied to electrodes provided on side surfaces of said partition walls to change the capacity in said chambers; and the ink filled in said chambers is jetted from nozzle openings, characterized in that:

said first board and said second board are formed of a dielectric material, and also wiring lines, which are electrically conducted to said electrodes and elongated to an outside of end portions of said partition walls in a longitudinal direction, are provided on a surface of either one of said first board and said second board; and further, said wiring lines include an inorganic conductive film as a lowermost layer and metal films formed thereon.

2. A head chip as claimed in claim 1, characterized in that said dielectric material is glass.

3. A head chip as claimed in claim 1 or 2, characterized in that said inorganic conductive film is made of at least one sort of material selected from the group consisting of ITO, $SnO_2$, ZnO, and ATO.

4. A head chip as claimed in claim 1 or 2, characterized in that said inorganic conductive film is elongated between one of said first board and said second board and the end portions of said partition walls in a width direction, and also an end portion of the elongated inorganic conductive film in the width direction and said electrodes are electrically conducted to each other.

5. A head chip as claimed in claim 4, characterized in that a thickness of said inorganic conductive film is set to be equal to or less than 3 $\mu$m.

6. A head chip as claimed in claim 1 or 2, characterized in that said electrodes and said metal films are formed by selective electroless plating.

7. A head chip as claimed in claim 1 or 2, characterized in that said electrodes and said metal films are formed of a nickel layer and a gold layer.

8. A head chip as claimed in claim 1 or 2, characterized in that a nozzle plate having said nozzle openings is provided at the end portions of said partition walls in the longitudinal direction, at which said chambers are opened, and also an ink chamber that communicates with said respective chambers is provided on an another end portion side of said partition walls.

9. A head chip as claimed in claim 8, characterized in that said nozzle plate is formed of a dielectric material.

10. A head chip as claimed in claim 1 or 2, characterized in that said partition walls are formed by jointing two sheets of piezoelectric ceramic having different polarization direction in the thickness direction.

11. A head chip as claimed in claim 1 or 2, characterized in that regions corresponding to said chambers are provided with concave portions in one of said first board and said second board, which is provided with said wiring lines.

12. A head chip as claimed in claim 1 or 2, characterized in that a driver circuit is provided with a region corresponding to said wiring lines in one of said first board and said second board, which is provided with said wiring lines.

13. A head unit characterized in that said head unit comprises the head chip as claimed in claim 1 or 2 and a head holder that mounts the head chip.

14. A head unit as claim in claim 13, characterized in that said head holder may detachably hold an ink cartridge in which ink is stored.

* * * * *